US005158208A

United States Patent [19]

Wilson

[11] Patent Number: 5,158,208

[45] Date of Patent: Oct. 27, 1992

[54] WATER CANNON APPARATUS

[76] Inventor: Joshua R. Wilson, P.O. Box 862, Port Sulphur, La. 70083

[21] Appl. No.: 699,574

[22] Filed: May 14, 1991

[51] Int. Cl.[5] ..... B67D 5/64

[52] U.S. Cl. ..... 222/78; 222/175; 222/192; 222/144.5; 222/389; 222/399; 2/160; 446/473; 446/483; 239/529

[58] Field of Search ..... 222/78, 79, 175, 192, 222/389, 399, 144.5; 2/159, 161 R, 160; 272/27 N, 27 W; 446/483, 267, 473; 239/153, 154, 529, 304, 305, 322

[56] References Cited

U.S. PATENT DOCUMENTS

| | | | |
|---|---|---|---|
| 1,177,412 | 3/1916 | Hopkins | 239/529 |
| 1,534,208 | 4/1925 | Gibson | 239/529 |
| 1,578,944 | 3/1926 | Wilkinson | 222/389 X |
| 1,764,968 | 6/1930 | Mendenhall | 222/389 |
| 1,885,180 | 11/1932 | Comeron | 222/175 |
| 1,902,548 | 3/1933 | Fenwick, Jr. | 222/175 |
| 1,954,728 | 4/1934 | Dolan | 222/399 |
| 2,192,082 | 2/1940 | Hunicke | 222/175 |
| 2,732,977 | 1/1956 | Charpiat | 222/399 |
| 2,774,521 | 12/1956 | Creighton | 222/399 |
| 2,808,965 | 10/1957 | Graphia, III et al. | 222/175 |
| 3,844,449 | 10/1974 | Alter | 222/175 |
| 4,037,790 | 7/1977 | Reiser et al. | 222/175 X |
| 4,903,864 | 2/1990 | Sirhan | 222/78 |
| 4,997,110 | 3/1991 | Swenson | 222/175 |
| 5,072,856 | 12/1991 | Kimble | 222/175 X |

FOREIGN PATENT DOCUMENTS

| | | | |
|---|---|---|---|
| 554089 | 6/1943 | United Kingdom | 222/175 |

*Primary Examiner*—Andres Kashnikow
*Assistant Examiner*—Anthoula Pomrening
*Attorney, Agent, or Firm*—Leon Gilden

[57] ABSTRACT

An apparatus including a fluid storage tank, with a torso belt organization for mounting the storage tank about a torso portion of an individual. A glove member is in fluid communication with the fluid storage tank, wherein the fluid storage tank is pressurized and the glove member includes at least one trigger member for effecting directing of fluid from within at least one compartmented chamber within the fluid storage tank.

1 Claim, 5 Drawing Sheets

WATER CANNON APPARATUS

BACKGROUND OF THE INVENTION

1. Field of the Invention

The field of invention relates to water cannon apparatus, and more particularly pertains to a new and improved water cannon apparatus wherein the same is arranged for selective discharge of fluid flow through a remote glove mounted in fluid communication with a water storage tank.

2. Description of the Prior Art

Water cannon and water gun apparatus is utilized in the prior art for amusement and entertainment of individuals. Such apparatus is typically of a unitary construction, and is exemplified in U.S. Pat. No. 4,750,641 to Chin-Fu. The gun member of the Chin-Fu patent includes a trigger member operative through an electrical motor to pressurize fluid flow therefrom.

U.S. Pat. No. 4,214,674 to Jones, et al. sets forth a pistol utilizing a remote fluid reservoir.

U.S. Pat. No. 4,257,460 to Paranay, et al. sets forth a water gun utilizing a collapsible water chamber mounted coaxially aligned with and rearwardly of the gun member.

U.S. Pat. No. 4,768,681 to Dean, et al. sets forth a fluid action toy for discharge of fluid therefrom, wherein a water chamber is mounted to a top surface of a glove member.

As such, it may be appreciated that there continues to be a need for a new and improved water cannon apparatus as set forth by the instant invention which addresses both the problems of ease of use as well as effectiveness in providing a remotely positioned fluid storage tank of ample configuration for torso support to provide prolonged use and enjoyment of the apparatus.

SUMMARY OF THE INVENTION

In view of the foregoing disadvantages inherent in the known types of water gun apparatus now present in the prior art, the present invention provides a water cannon apparatus wherein the same utilizes a fluid storage tank utilizing a plurality of compartmentalized chambers to selectively direct fluid flow from one of a plurality of ports and a remotely positioned glove member in communication with the fluid storage tank. As such, the general purpose of the present invention, which will be described subsequently in greater detail, is to provide a new and improved water cannon apparatus which has all the advantages of the prior art water gun apparatus and none of the disadvantages.

To attain this, the present invention provides an apparatus including a fluid storage tank, with a torso belt organization for mounting the storage tank about a torso portion of an individual. A glove member is in fluid communication with the fluid storage tank, wherein the fluid storage tank is pressurized and the glove member includes at least one trigger member for effecting directing of fluid from within at least one compartmented chamber within the fluid storage tank.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matte of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved water cannon apparatus which has all the advantages of the prior art water gun apparatus and none of the disadvantages.

It is another object of the present invention to provide a new and improved water cannon apparatus which may be easily and efficiently manufactured and marketed.

It is a further object of the present invention to provide a new and improved water cannon apparatus which is of a durable and reliable construction.

An even further object of the present invention is to provide a new and improved water cannon apparatus which is susceptible of a low cost of manufacture with regard to both materials and labor, and which accordingly is then susceptible of low prices of sale to the consuming public, thereby making such water cannon apparatus economically available to the buying public.

Still yet another object of the present invention is to provide a new and improved water cannon apparatus which provides in the apparatuses and methods of the prior art some of the advantages thereof, while simultaneously overcoming some of the disadvantages normally associated therewith.

Still another object of the present invention is to provide a new and improved water cannon apparatus wherein the same is arranged for remotely mounting a fluid storage tank relative to a selectively operative glove member for use and securement by an individual.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
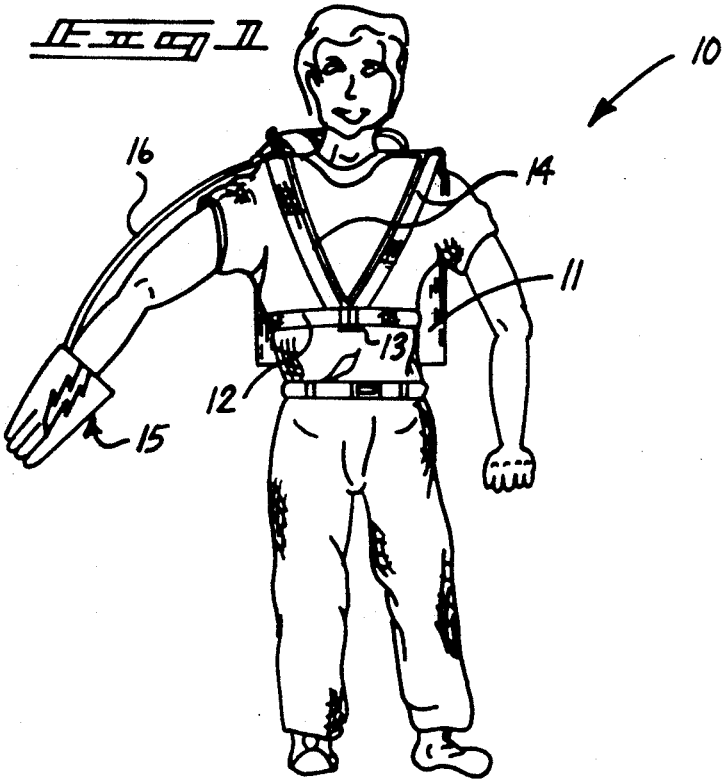
FIG. 1 is an orthographic view of the invention mounted to an individual.

With reference now to the drawings, and in particular to FIGS. 1 to 10 thereof, a new and improved water cannon apparatus embodying the principles and concepts of the present invention and generally designated by the reference numeral 10 will be described.

Figure 2:
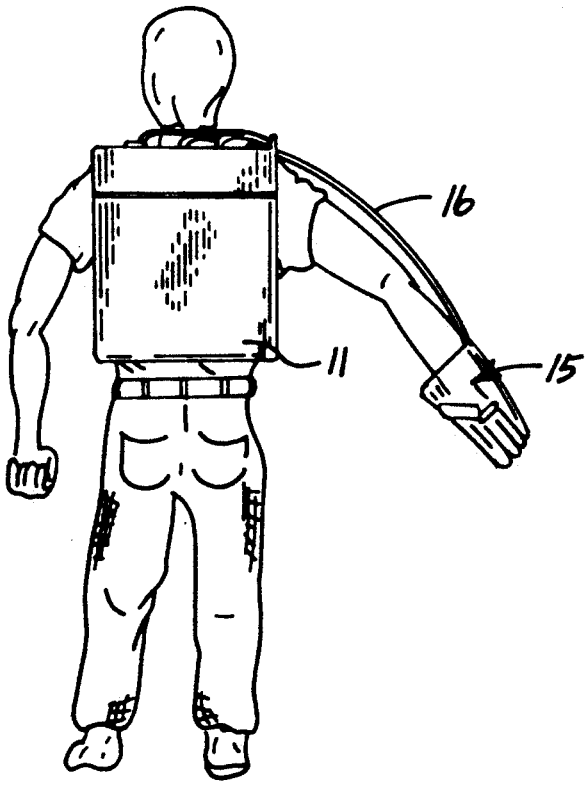
FIG. 2 is an orthographic rear view, taken in elevation, of the apparatus mounted to an individual.
Figure 3:
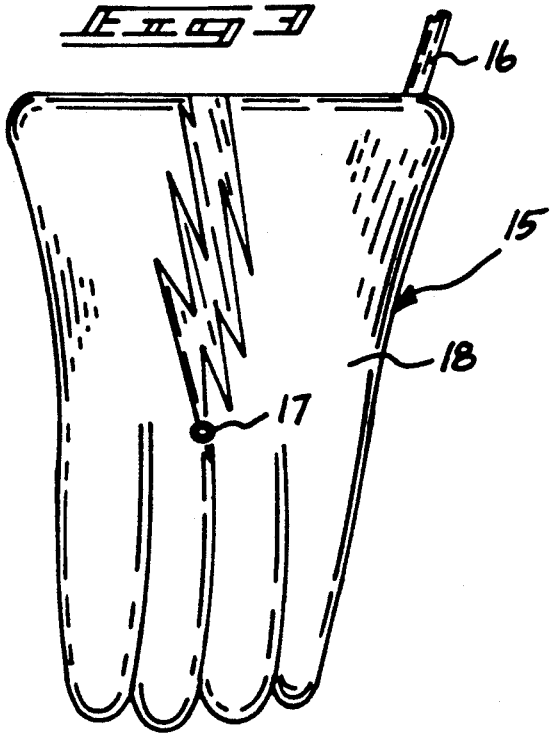
FIG. 3 is an orthographic top view of the glove member utilized by the instant invention.
Figure 4:
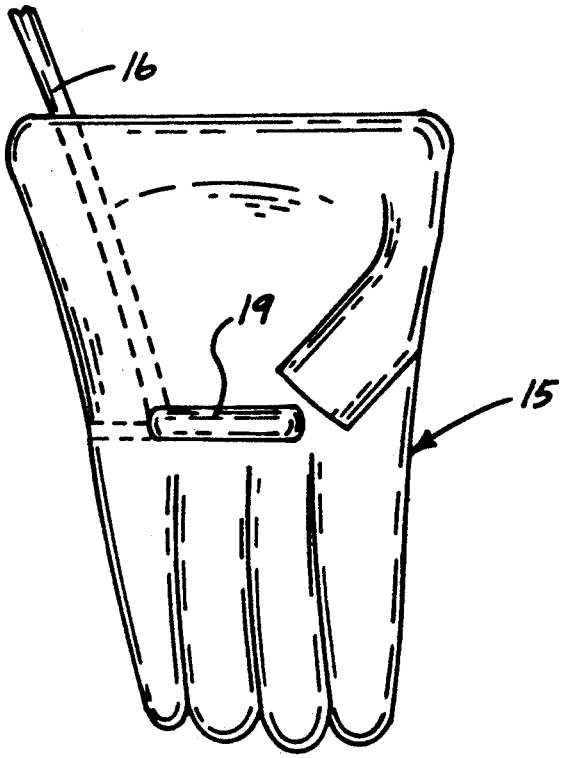
FIG. 4 is a bottom orthographic view of the glove member utilized by the instant invention.

More specifically, the water cannon apparatus 10 of the instant invention essentially comprises a fluid storage tank 11, with a torso belt 12 mounted thereto. The torso belt 12 includes a belt buckle 13 mounted medially of the belt for securement about a torso portion of an individual. A plurality of shoulder straps 14 merge at an intersection of the torso belt and the buckle for ease of mounting of the belt structure to the individual, as illustrated in FIGS. 1 and 2.

A glove member 15 is in fluid communication by use of a fluid conduit 16 with the fluid storage tank 11. The glove member 15 includes an outlet port 17 projecting through a glove top surface 18 positioned medially thereof at an intersection of finger sockets of the glove with the glove body. A trigger valve 19 is positioned through a glove bottom surface for operative association with the outlet port 17 to effect selective fluid flow therethrough. The fluid storage tank 11 is pressurized utilizing various pressurizing means, such as pressurized containers.

Figure 5:
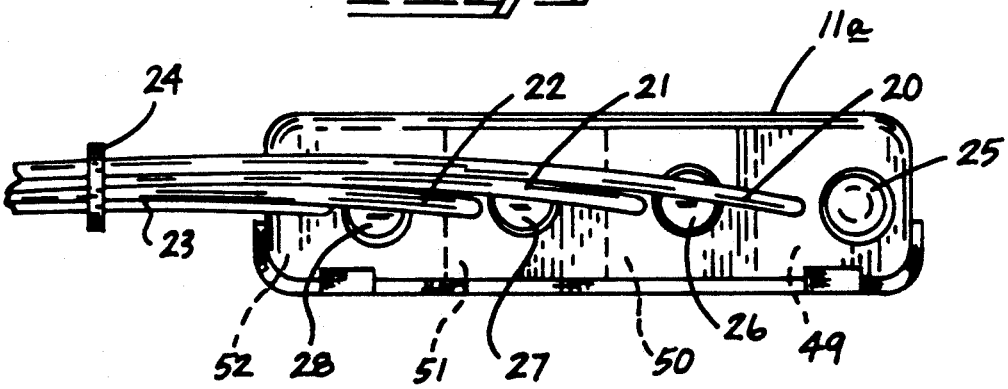
FIG. 5 is an orthographic top view of the fluid storage tank utilized by the instant invention.

FIG. 5 illustrates the use of a modified fluid storage tank 11*a* compartmentalized, utilizing a separate fluid conduit directed from each compartmentalized chamber into an associated glove member. The compartmentalized chambers are in fluid communication by use of a respective first, second, third, and fourth fluid conduit identified as numerals 20, 21, 22, and 23 respectively. A harness collar 24 is positioned in spaced relationship relative to the fluid storage tank 11 for the binding and positioning of the plurality of fluid conduits in a compact organization, with the harness collar 24 fixedly secured in surrounding relationship relative to the fluid conduits and orthogonally oriented relative to the fluid conduits. Each chamber includes a respective removable fill cap defined by a respective first, second, third, and fourth fill cap 25, 26, 27, and 28 for permitting selective filling of each chamber defined by a respective first, second, third, and fourth chamber 49, 50, 51, and 52 respectively.

Figure 6:
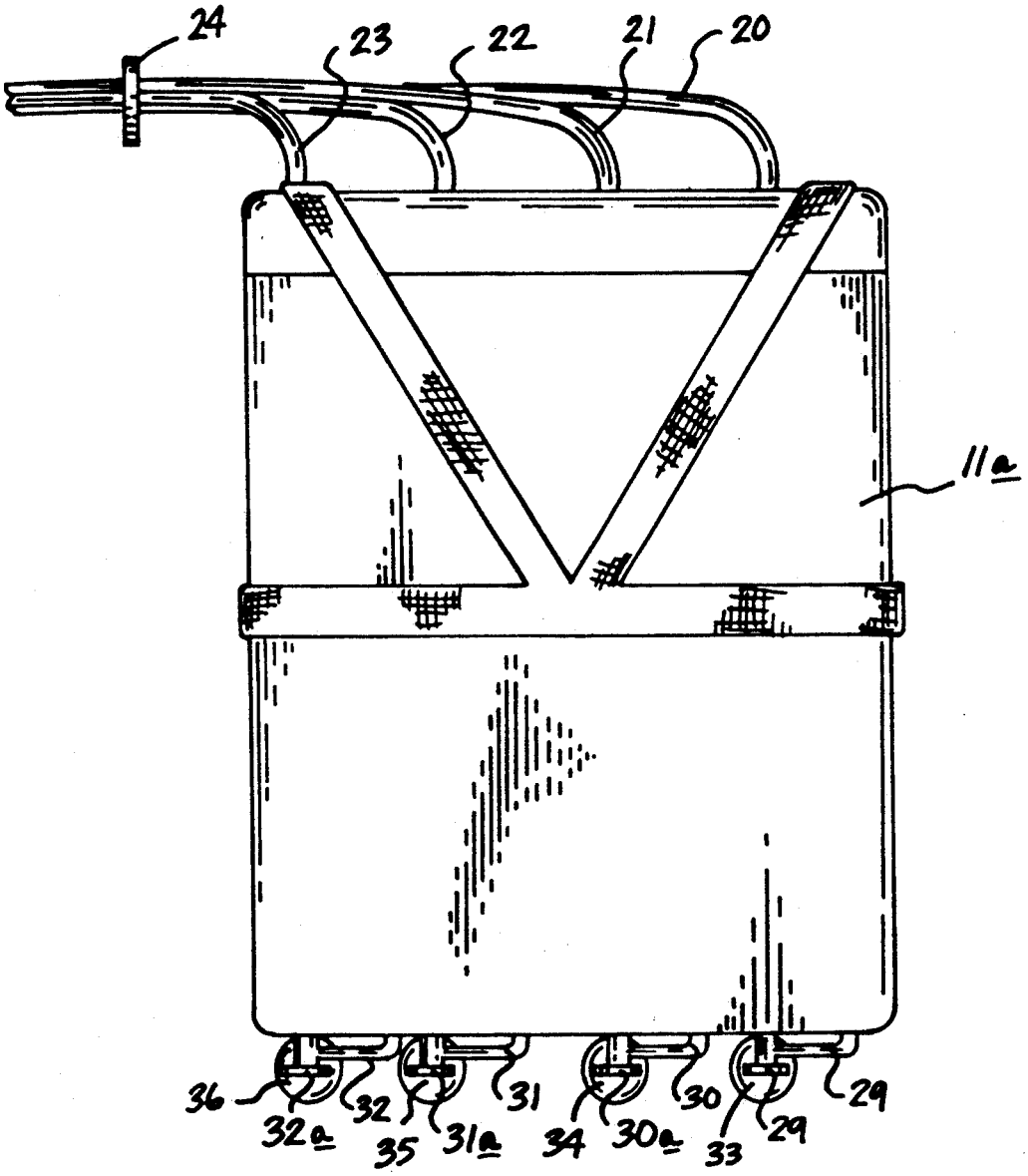
FIG. 6 is an orthographic rear view, taken in elevation, of a modified fluid storage tank utilized by the instant invention.
Figure 7:
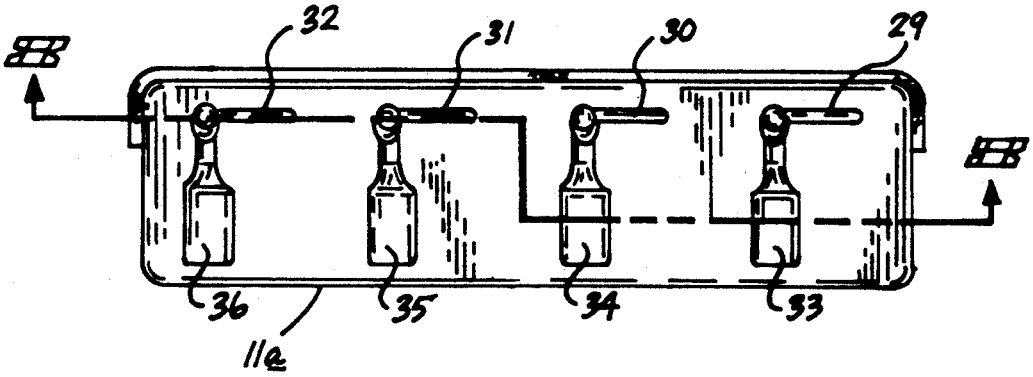
FIG. 7 is an orthographic bottom view of the fluid storage tank utilized by the instant invention, as set forth in FIG. 6.
Figure 8B:
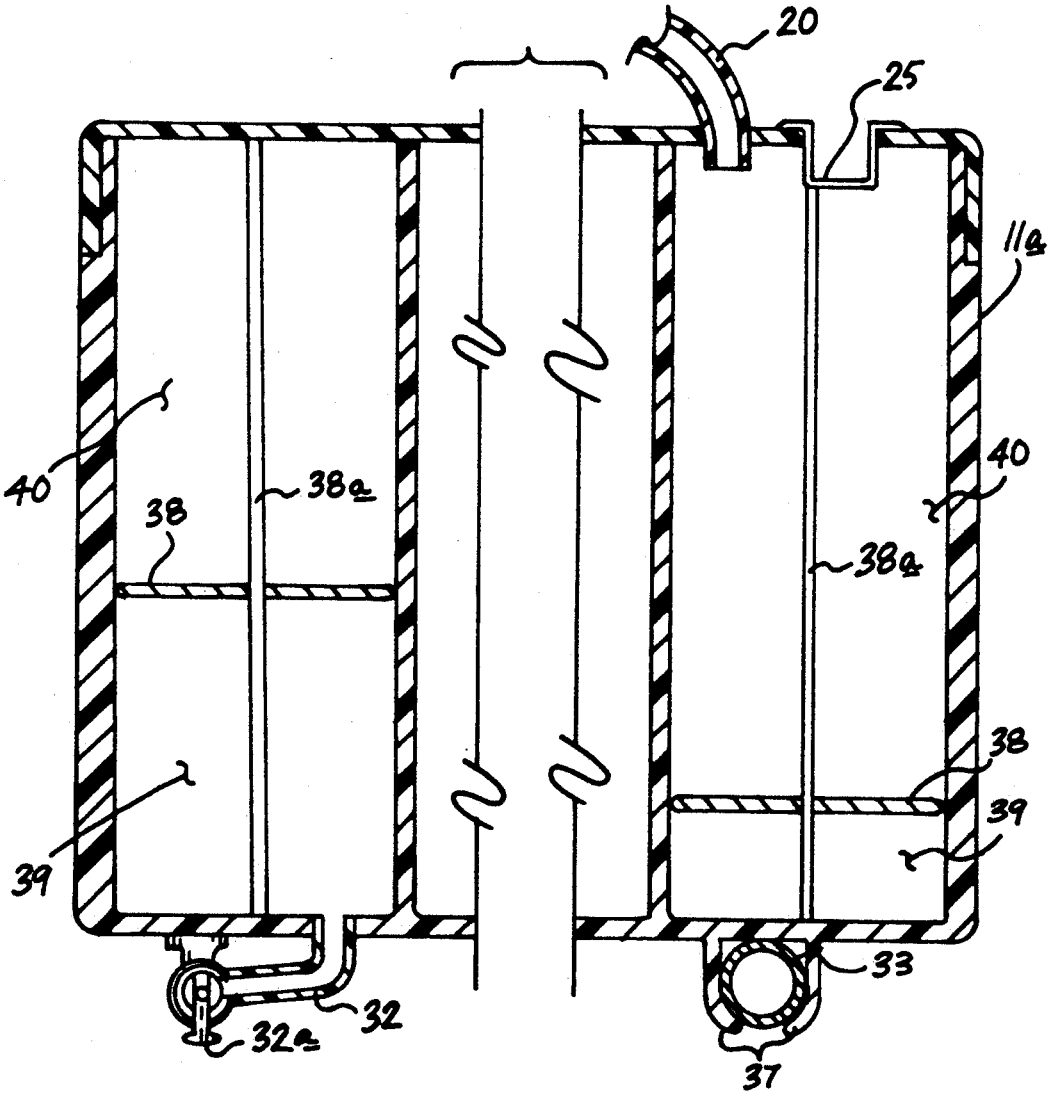
FIG. 8 is an orthographic view, taken along the lines 8—8 of FIG. 7 in the direction indicated by the arrows.
Figure 9:
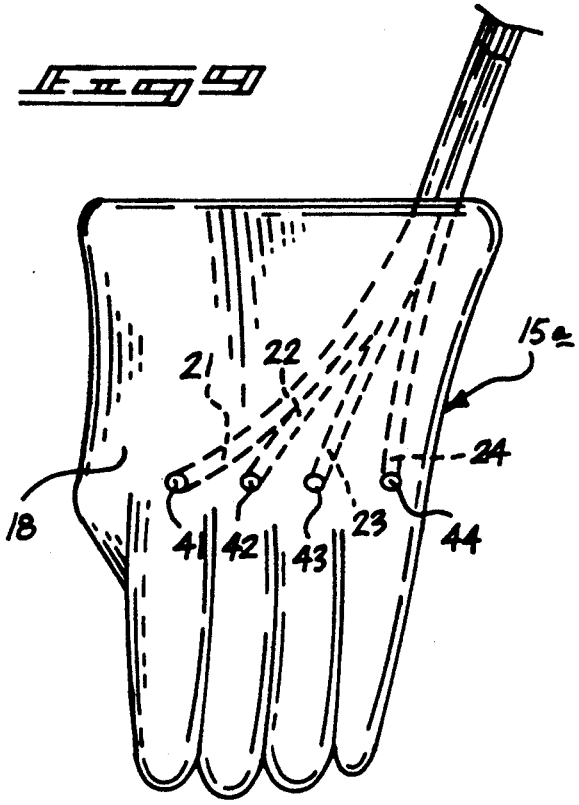
FIG. 9 is an orthographic top view of a modified glove member utilized by the instant invention.
Figure 10:
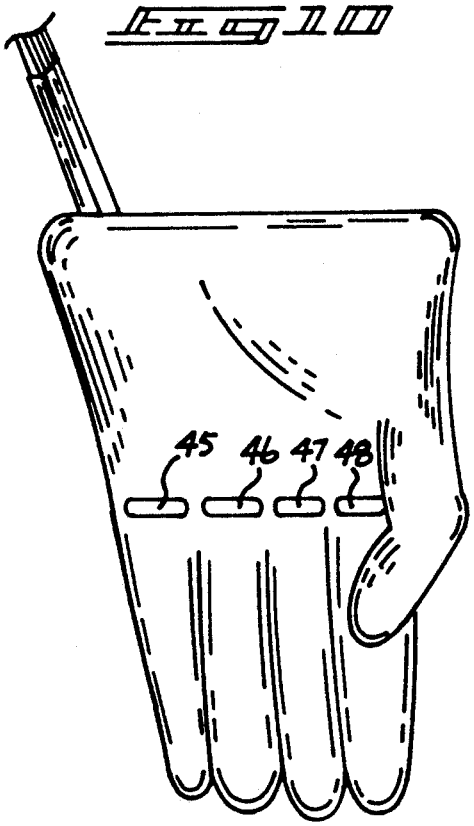
FIG. 10 is an orthographic bottom view of the modified glove member, as set forth in FIG. 9.

FIGS. 6 and 7 illustrate a pressure container in operative association with each of the chambers 49–52, wherein each chamber includes a respective first, second, third, and fourth pressure conduit 29, 30, 31, and 32 operative through respective first, second, third, and fourth valve 29*a*, 30*a*, 31*a*, and 32*a* to direct pressurizing of each chamber by a respective first, second, third, and fourth pressure container 33, 34, 35, and 36 mounted to the bottom surface of the fluid storage tank 11 between flexible mounting ears 37 to permit selective removal and replacement of each pressure container relative to the bottom surface of the fluid storage tank 11. Each chamber, as exemplified in FIG. 8, utilizes a piston plate 38 that is guided by a guide rod 38*a* that is coaxially aligned with each respective chamber and coaxially directed through each piston plate 38. The piston plate 38 divides each chamber 49–52 into a lower pressure chamber 39 in pressurized communication with the respective pressure conduit and an upper fluid chamber 40 receiving fluid through a respective fill cap. Upon pressurizing the fluid chamber 40, fluid is directed through a respective fluid conduit of the first through fourth fluid conduits 20–23 and directed from an outlet port, such as illustrated by the outlet port 17 of FIG. 3, or alternatively utilized in the modified glove structure 15*a*, as illustrated in FIGS. 9 and 10, by a respective first, second, third, and fourth outlet port 41, 42, 43, and 44. Each of the outlet ports are positioned at an intersection of the finger sockets of each of the fingers of an associated glove member and directed through a top surface of the glove body. A bottom surface of the glove body includes a respective first, second, third, and fourth trigger valve 45, 46, and 47 that is in operative association with each respective outlet port permitting selective fluid flow from each chamber. In this manner, various fluids may be utilized, such as fluids with water soluble dyes to impart a desired effect upon a target.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the U.S. is as follows:

1. A water cannon apparatus, comprising in combination, a fluid storage tank, the fluid storage tank including a torso belt, the torso belt including a buckle positioned medially of the torso belt, and the torso belt including a plurality of shoulder straps, wherein the shoulder straps merge at the torso belt adjacent the buckle, and a glove member, and fluid conduit means, the fluid conduit means arranged for effecting fluid communication between the fluid storage tank and the glove member, and the fluid conduit means including at least one outlet port means directed through the glove member for directing fluid therethrough, the glove member including a plurality of finger sockets and a glove body, and the outlet port means positioned through A bottom surface of the glove body at an intersection of at least one of said finger sockets and the glove body, and at least one trigger valve associated with said at least one outlet port means, wherein the at least one outlet port means is directed through a bottom surface of the glove body for effecting release of fluid through the at least one outlet port means, and the fluid storage tank includes a plurality of fluid chambers, each fluid chamber including a fill cap directed through a top surface of the fluid storage tank, and said fluid conduit means including a fluid conduit for each fluid chamber of the plurality of fluid chambers, and said outlet port means including an outlet port for each fluid conduit, and the fluid storage tank includes a tank bottom wall, the tank bottom wall including a plurality of pressure conduits, each of the plurality of pressure conduits in pneumatic communication into a respective chamber of the plurality of chambers, and each pressure conduit including a pressure container, and each pressure container releasably mounted to the bottom wall, and each pressure container including a plurality of flexible mounting ears mounted to the bottom wall to effect selective securement of each pressure container to the bottom wall, and each pressure conduit includes a valve to effect selective release of pneumatic pressure from each pressure container into a respective chamber of the plurality of chambers, and each chamber includes a guide rod longitudinally and medially positioned coextensively of each chamber, and each guide rod includes a piston plate slidably mounted along each guide rod, and each piston plate divides each chamber into an upper fluid chamber and a lower pressure chamber, wherein pressurizing of each lower pressure chamber through a respective pressure conduit effects pressurizing of fluid contained within each fluid chamber.

* * * * *